US006422398B2

(12) United States Patent
LaFontaine et al.

(10) Patent No.: US 6,422,398 B2
(45) Date of Patent: Jul. 23, 2002

(54) MODULAR ORGANIZER

(75) Inventors: Pamela R. LaFontaine, Coon Rapids; Stanley R. Thorud, New Hope, both of MN (US)

(73) Assignee: Safco Products Company, Minneapolis, MN (US)

( * ) Notice: Subject to any disclaimer, the term of this patent is extended or adjusted under 35 U.S.C. 154(b) by 0 days.

(21) Appl. No.: 09/871,215

(22) Filed: May 31, 2001

Related U.S. Application Data

(62) Division of application No. 09/542,771, filed on Apr. 4, 2000, now abandoned.

(51) Int. Cl.[7] ..... A47B 47/00
(52) U.S. Cl. ..... 211/10; 211/194; 211/188
(58) Field of Search ..... 211/186, 189, 211/194, 188, 10

(56) References Cited

U.S. PATENT DOCUMENTS

| | | | | |
|---|---|---|---|---|
| 3,807,572 A | | 4/1974 | Luvara et al. | |
| 4,423,913 A | * | 1/1984 | Lee | 211/194 X |
| D272,699 S | * | 2/1984 | Godfrey | 211/74 X |
| 4,505,395 A | | 3/1985 | Nathan | |
| 4,852,749 A | * | 8/1989 | Fernandez et al. | 211/194 X |
| 4,889,244 A | * | 12/1989 | Hehn et al. | 211/194 X |
| 4,907,703 A | | 3/1990 | Alger et al. | |
| 5,088,619 A | * | 2/1992 | Shank | 220/532 |
| 5,322,167 A | | 6/1994 | Birutis et al. | |
| 5,497,888 A | | 3/1996 | Michaels et al. | |
| 5,657,880 A | | 8/1997 | Birnbaum | |
| 6,142,316 A | * | 11/2000 | Harbour et al. | 211/74 X |
| 6,209,735 B1 | * | 4/2001 | Gladstone et al. | 211/194 X |

* cited by examiner

*Primary Examiner*—Daniel P. Stodola
*Assistant Examiner*—Erica B. Harris
(74) *Attorney, Agent, or Firm*—Patterson, Thuente, Skaar & Christensen, P.A.

(57) ABSTRACT

A modular organizer includes a plurality of walls, two faceplates, and a plurality of shelves. In a storage mode, the walls and shelves of the organizer are stored within the containing walls of the face plates. The containing walls of the faceplates are each equipped with an exterior edge that presents an uneven outline. When the uneven outlines of each faceplate are positioned adjacent each other, a substantially sealed interface is created containing the walls and shelves within. In an organizer mode, the walls are supported by, and serve to separate the faceplates. The shelves are placed within the structure formed by the walls and are positionable between a display and storage position. Each faceplate of each modular organizer is identically configured to incorporate at least one post and hole pair. When one modular organizer is placed adjacent another, the post of one engages the hole of the other and vice-versa allowing a user to fashion virtually any desired modular organizing unit to fit a specific space, e.g., side-by-side, top-to-bottom and bottom-to-top positioning of multiple modular organizers.

13 Claims, 12 Drawing Sheets

MODULAR ORGANIZER

This application is a divisional application of application Ser. No. 09/452,771, filed Apr. 4, 2000, now abandoned.

FIELD OF THE INVENTION

The present invention relates to devices for storing and/or organizing literature, papers and, in general, office products. More particularly, the present invention relates to a modular device which is conveniently packaged, easily assembled, and combined with one or more additional modular devices into a user's desired configuration.

BACKGROUND OF THE INVENTION

Modular organizers are convenient devices for organizing numerous types of spaces because they allow the user to configure the modular organizers in a fashion to best suite the space. For instance, modular organizers may be used alone or in combination with a small number of other modular organizers to organize a table or desktop. A greater number of modular organizers may be used, e.g., in stacks, towers, rows, etc., to organize a wall space or floor space. Because a user will generally do the work himself in creating a desired modular organizer configuration, it is important that the modular organizer itself be easy to assemble and easily attached to other like modular organizers. Additionally, because modular organizers are often used in place of more expensive wooden bookcases, it is important that the cost to the user be as low as possible.

U.S. Pat. No. 3,807,572 describes an adjustable compartment size storage unit wherein the units are attached to each other by aligning holes within each unit and securing the units via a nut and bolt combination, wherein the bolt is inserted through the aligned holes. As such, an additional component beyond the unit itself is required for securement to another unit. That additional component adds cost to each unit and extra effort for the user in attempting alignments and the screwing on bolts. Likewise, U.S. Pat. No. 4,505,395 describes a magazine display tray that may be attached to additional trays by use of an external clip device that is inserted into each adjacent tray. Again, the additional part makes assembly more complex and requires the creation of an expensive mold to manufacture the external clip device adding cost to the overall unit.

U.S. Pat. No. 5,657,880 describes a modular bin and organizer that in one sense avoids the use of an external, additional component for securing two units together. Here a dowel and hole combination are used, i.e., the dowel extending upward from a lower unit is inserted into the bottom-located hole of a top unit. The limitation in this arrangement is that dowel and hole combination only allow for an upward stacking pattern, e.g., no side-by-side pattern of units by using the dowel and hole combination, and further, top and bottom units are not interchangeable, e.g., the top unit must always be a top unit and the bottom unit must always be a bottom unit.

In view of the above, there is a need for a modular organizer that is easily assembled and secured to other modular organizers in virtually any desired fashion without the use of additional, external components.

SUMMARY OF THE INVENTION

The needs described above are in large measure solved by the modular organizer of the present invention. The modular organizer has both a storage mode, in which the organizer can be shipped, sold and/or stored, and an organizer mode, in which the modular organizer is assembled and useful for organizing various items. The modular organizer generally incorporates a plurality of walls, e.g., two side panels, a top panel, and a bottom panel, and two base sections, e.g., face plates. Each of the base sections includes a containing wall which extends around its perimeter and the containing wall has an exterior edge that presents an uneven outline, such as a wave or step.

In storage mode, the walls are stored within the containing wall of the base sections and the uneven outlines of the containing walls are placed proximate each other to substantially, sealingly interface creating a neat compact package for shipping, sale and/or storage. In organizer mode, the walls serve to separate, and are supported by, the base sections. The modular organizer may be converted from organizer mode to storage mode and storage mode to organizer mode any number of times. The modular organizer additionally preferably includes shelves and a back panel which may also be stored within the containing walls of the base sections. The shelves are preferably positionable in a display (angled) position or storage (horizontal) position.

Any number of modular organizers may be combined to create a singular modular unit of a desired configuration. The base sections, which are preferably four-sided, of each modular organizer preferably include at least one post and hole pair per side. As such, when one modular organizer is placed adjacent another modular organizer, the post of one organizer engages the hole of the other and vice-versa. This identical configuration of base sections thus requires only a single manufacturing mold, thereby reducing cost, and allows side-by-side, top-to-bottom, and bottom-to-top placement of adjacent modular organizers. Note, that the hole used for engaging another modular organizer may also be used in securing the walls to the base sections.

DESCRIPTION OF THE DRAWINGS

FIG. 12 is a partial perspective of the inside of the side panel of FIG. 6.

DESCRIPTION OF THE PREFERRED EMBODIMENTS

Figure 1:
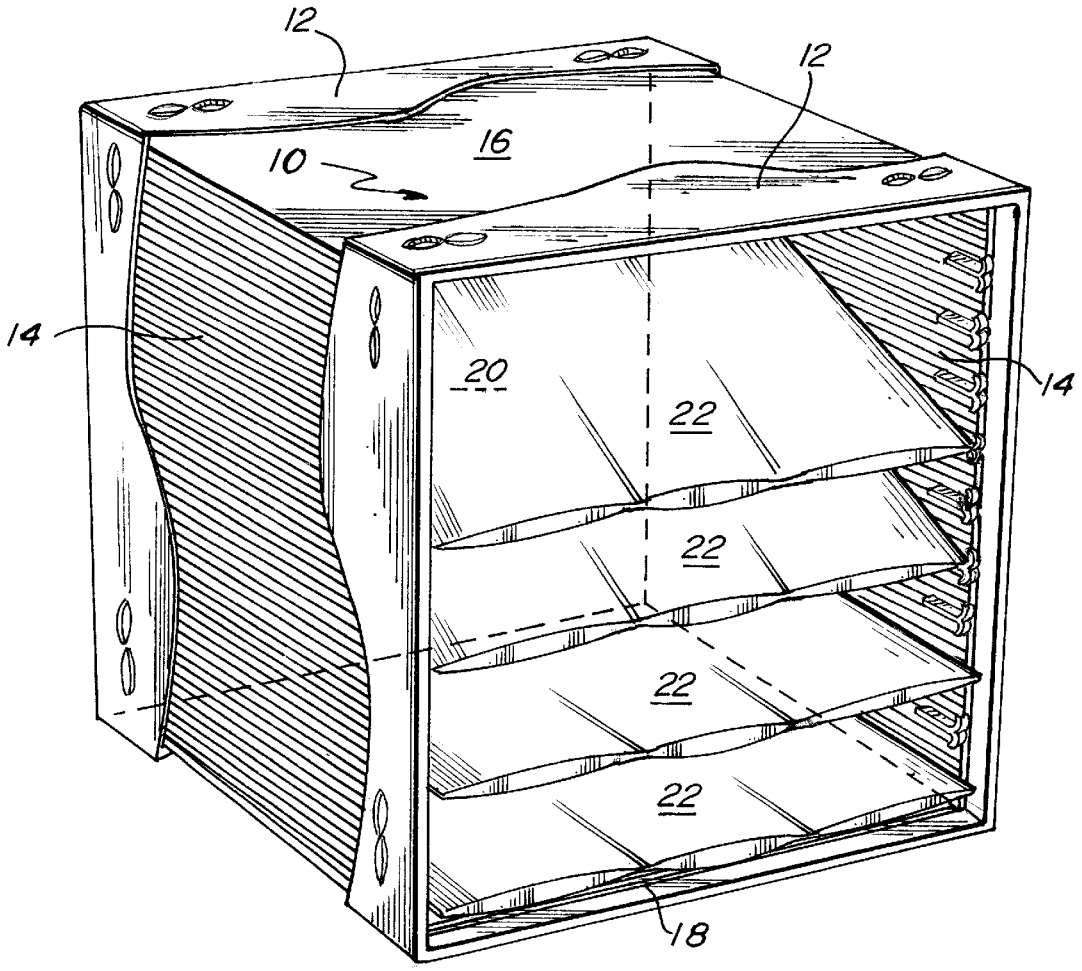
FIG. 1 depicts a modular organizer of the present invention in a fully assembled configuration presenting two shelves in a storage mode and two shelves in a display mode.

A modular organizer 10, see FIG. 1, of the present invention is an article of manufacture that may be conveniently packaged, easily assembled, and combined with one or more additional modular organizers 10 to create a desired storage configuration that may be used on a desk, shelf, or on the floor. Modular organizer 10 preferably incorporates two face plates 12, two side panels 14, a top panel 16, a bottom panel 18, a back panel 20 and a plurality of shelves 22.

Referring to FIGS. 6–12, side panels 14 are depicted in detail. Each side panel 14 has an outer surface 50 defined by a plurality of ribbings 51 (some ribbings 51 are not shown for clarity of view). Outer surface 50 is additionally defined by four petal-shaped bosses 52, located near the comers of outer surface 50, and a pair of outer ribs 54 that are substantially transverse to the plurality of ribbings 51 but incorporating the sweep configuration of outline 34. Each side panel 14 also has an inner surface 56 that is defined by a plurality of ribbings 57 (some ribbings 57 are not shown for clarity of view). Ribbings 51 and 57 allow for a thicker overall side panel 14 while using less fabrication material. Inner surface 56 is additionally defined by a pair of inner ribs 58 that are substantially transverse to ribbings 57 and substantially linear in nature. Outer ribs 54 and inner ribs 58 add structural stability to side panel 14.

Referring to FIGS. 6–12, side panels 14 are depicted in detail. Each side panel 14 has an outer surface 50 defined by a plurality of ribbings 51 (some ribbings 51 are not shown for clarity of view). Outer surface 50 is additionally defined by four petal-shaped bosses 52, located near the comers of outer surface 50, and a pair of outer ribs 54 that are substantially transverse to plurality of ribbings 51 but incorporating the sweep configuration of outline 34. Each side panel 14 also has an inner surface 56 that is defined by a plurality of ribbings 57 (some ribbings 57 are not shown for clarity of view). Ribbings 51 and 57 allow for a thicker overall side panel 14 while using less fabrication material. Inner surface 56 is additionally defined by a pair of inner ribs 58 that are substantially transverse to ribbings 57 and substantially linear in nature. Outer ribs 54 and inner ribs 58 add structural stability to side panel 14.

Inner surface 56 further includes a plurality of shelf supports 60. Each shelf support 60 preferably includes an elongate, substantially linear leader portion 62 as well as a rounded, upper hook portion 64 and a rounded, lower hook portion 66. However, note that the topmost shelf support 60 preferably has only leader portion 62 and lower hook portion 66 while lowermost shelf support 60 preferably has only leader portion 62 and upper hook portion 64.

Figure 8:
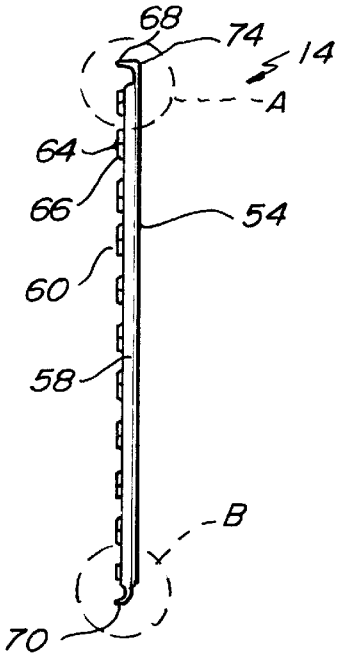
FIG. 8 is a side view of the side panel of FIG. 6.
Figure 9:
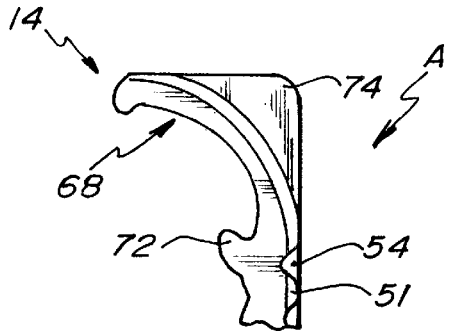
FIG. 9 is a detail view of section A, as indicated on FIG. 8.
Figure 10:
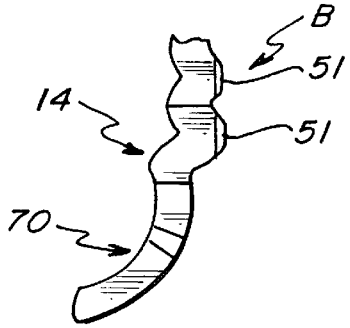
FIG. 10 is a detail view of section B, as indicated on FIG. 8.

Each side panel 14 additionally includes a top edge 68 and a bottom edge 70, which are depicted most clearly in FIGS. 8–10. Top edge 68 has a radiused configuration that, along with lip edge 72, accepts and holds an edge of top panel 16. Bottom edge 70 is also of a radiused configuration but does not include a lip edge. Note that each of outer ribs 54 extends up and over top edge 68 thereby creating a rib comer 74 that is at approximately a right angle. The tip of rib corner 74 is preferably rounded to eliminate the presence of a sharp edge. Outer ribs 54, however, do not extend over bottom edge 70, but rather, preferably stop at the last one of the plurality of ribbings 51 prior to bottom edge 70.

Referring to FIGS. 13–17, top panel 16 and bottom panel 18, which is identical to top panel 16, are depicted by singular representation. Each panel 16, 18 has an outer surface 80 defined by a plurality of ribbings 81 (some ribbings 81 are not shown for clarity of view). Outer surface 80 is additionally defined by four petal-shaped bosses 82, located near the comers of outer surface 80, and a pair of outer ribs 84 that are substantially transverse to plurality of ribbings 81 but incorporating the sweep configuration of outline 34. Each panel 16, 18 also has an inner surface 86 that is defined by a plurality of ribbings 87 (some ribbings 87 are not shown for clarity of view). Ribbings 81 and 87 allow for a thicker overall panel 16, 18 while using less fabrication material. Inner surface 86 is additionally defined by a pair of inner ribs 88 that are substantially transverse to ribbings 87 and substantially linear in nature. Outer ribs 84 and inner ribs 88 add structural stability to panel 16, 18.

Figure 16:
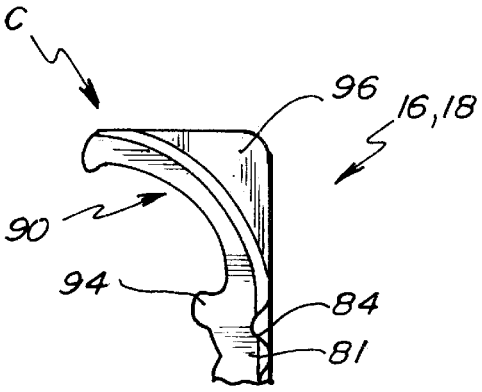
FIG. 16 is a detail view of section C, as indicated on FIG. 15.
Figure 17:
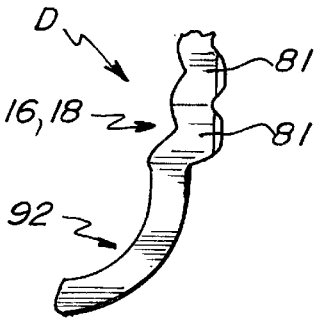
FIG. 17 is a detail view of section D, as indicated on FIG. 15.
Figure 10:
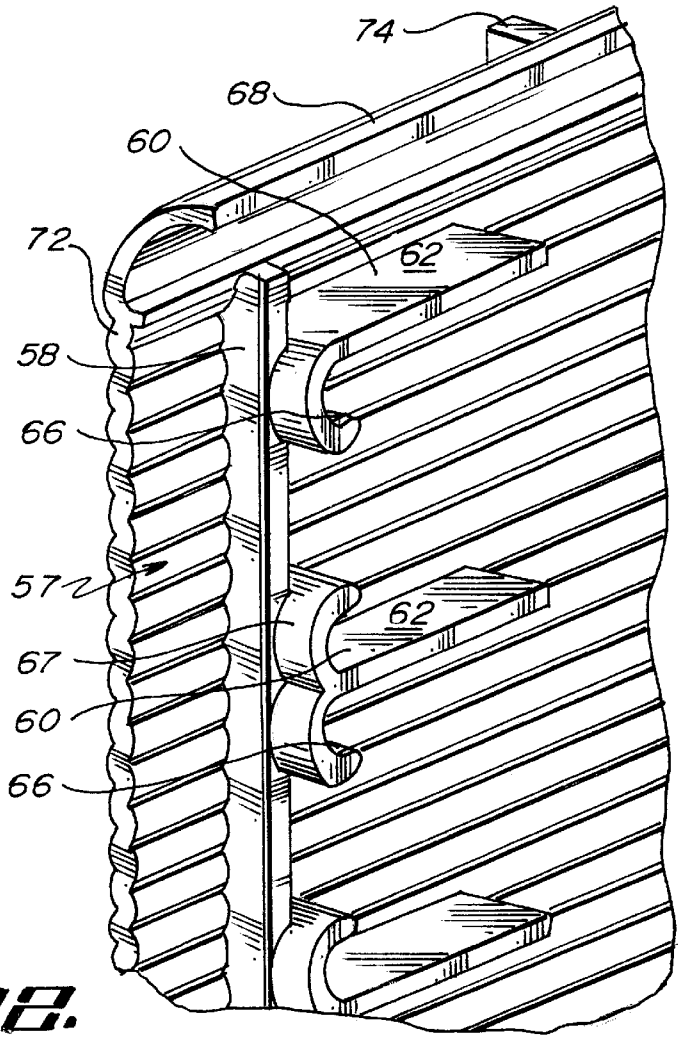
Figure 11:
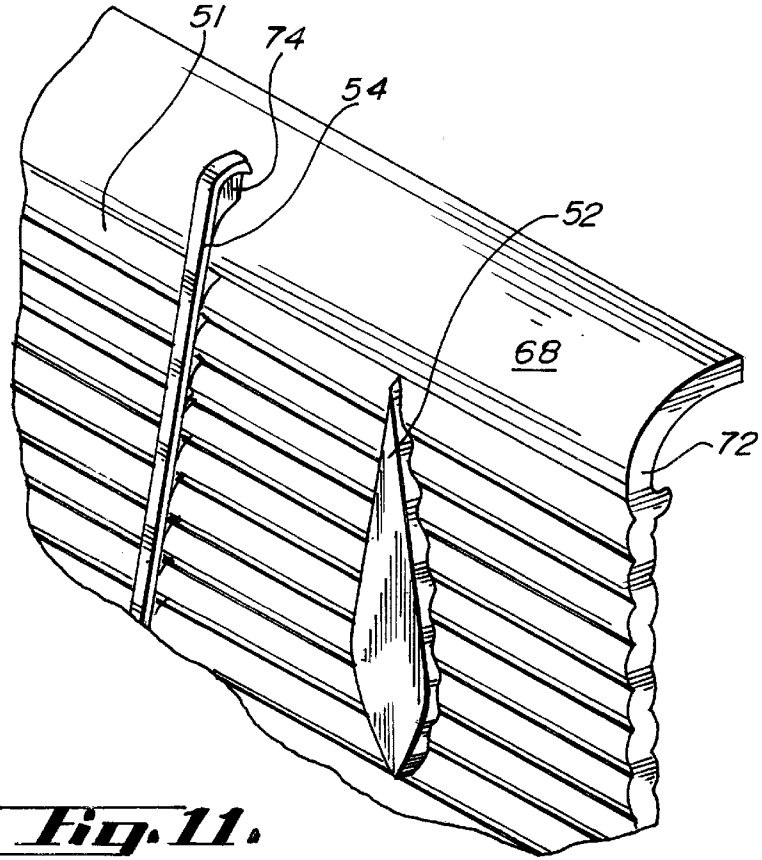
FIG. 11 is a partial perspective of the outside of the side panel of FIG. 6.
Figure 13:
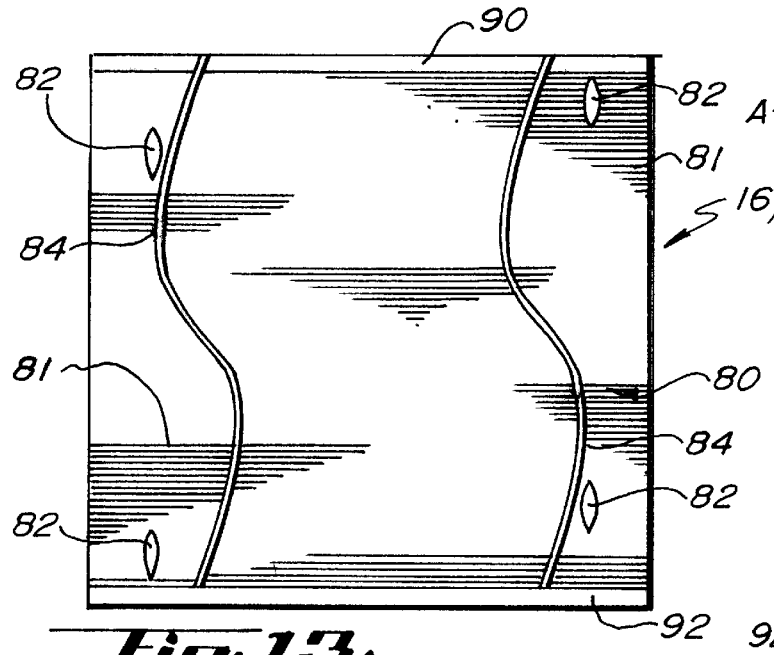
FIG. 13 is an outside view of a top or bottom panel of the modular organizer of the present invention.
Figure 15:
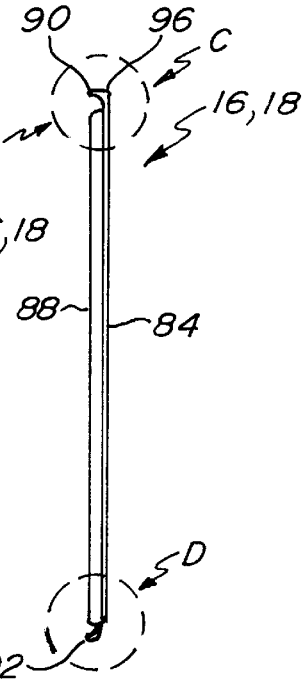
FIG. 15 is a side view of the top or bottom panel of FIG. 13.
Figure 14:
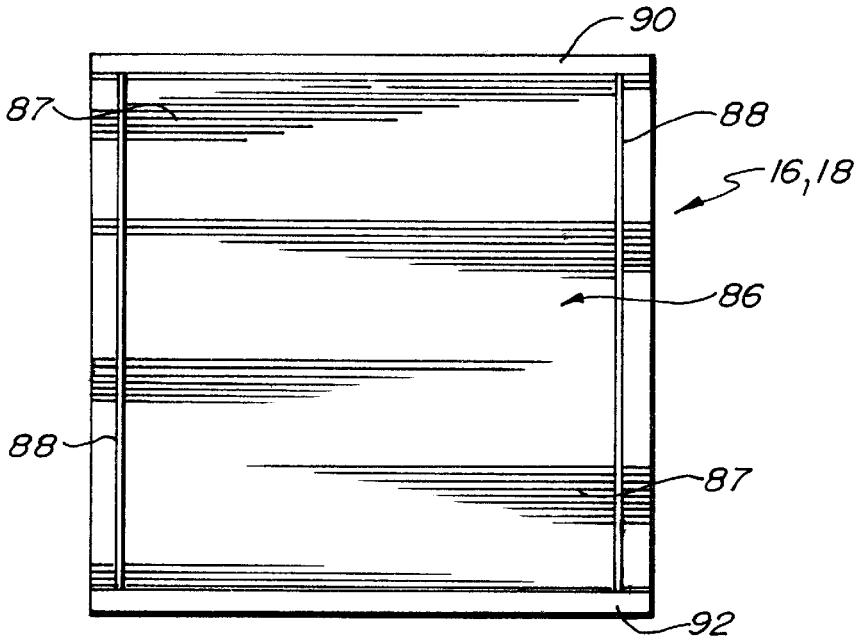
FIG. 14 is an inside view of the top or bottom panel of FIG. 13.

Each panel 16, 18 additionally include a first side edge 90 and a second side edge 92, which are depicted most clearly in FIGS. 15–17. First side edge 90 has a radiused configuration that, along with lip edge 94, accepts and holds bottom edge 70 of side panel 14. Second side edge 92 is also of a radiused configuration but does not include a lip edge. Note that each of outer ribs 84 extends up and over first side edge 90 thereby creating a rib corner 96 that is at approximately a right angle. The tip of rib corner 96 is preferably rounded to eliminate the presence of a sharp edge. Outer ribs 84, however, do not extend over second side edge 92, but rather, preferably stop at the last one of plurality of ribbings 81 prior to second side edge 92.

Figure 18:
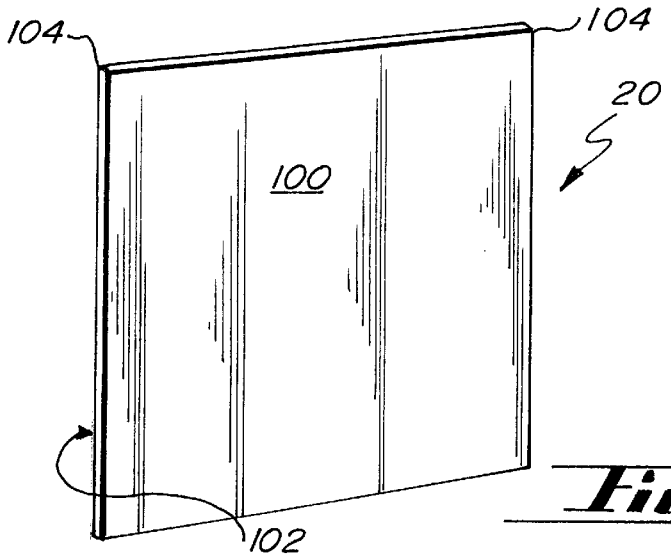
FIG. 18 is a perspective view of a back panel of the modular organizer of the present invention.

Referring to FIG. 18, back panel 20 is depicted. Back panel 20 is a thin sheet having a substantially square configuration. A front surface 100 and back surface 102 of back panel 20 are preferably identical in that they are each substantially planar. Back panel 20 is preferably provided with rounded comers 104 to eliminate the presence of a sharp point.

Referring to FIGS. 19–24, one of shelves 22 is depicted in detail. Each shelf 22 preferably includes a top surface 110 that is substantially planar. Additionally, each shelf 22 preferably includes two side edges 112. Each side edge 112 has a first cut-out portion 114, serving to narrow the overall width of shelf 22 at a first end of shelf 22. Located within each first cut-out portion 114 is a storage post 116 that is used to help position shelf 22 when in a storage orientation. Each side edge 112 also has a second cut-out portion 118, serving to narrow the overall width of shelf 22 at a second end of shelf 22. The length of second cut-out portion 118 is slightly less than the length of first cut-out portion 114. Located within each second cut-out portion 118 is a display post 120 that is used to help position shelf 22 when in a display orientation.

Figure 19:
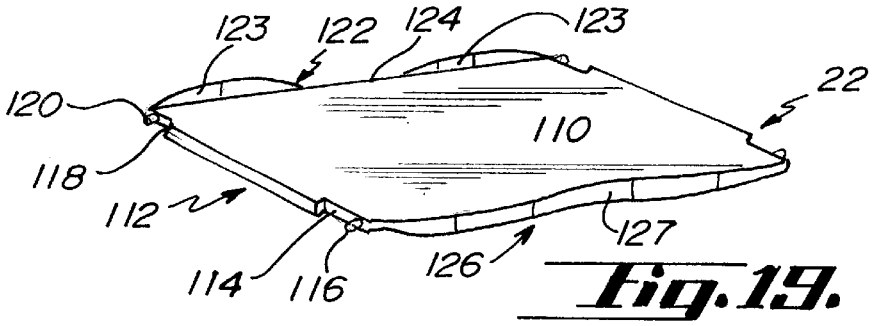
FIG. 19 is a perspective view of a shelf of the modular organizer of the present invention.
Figure 20:
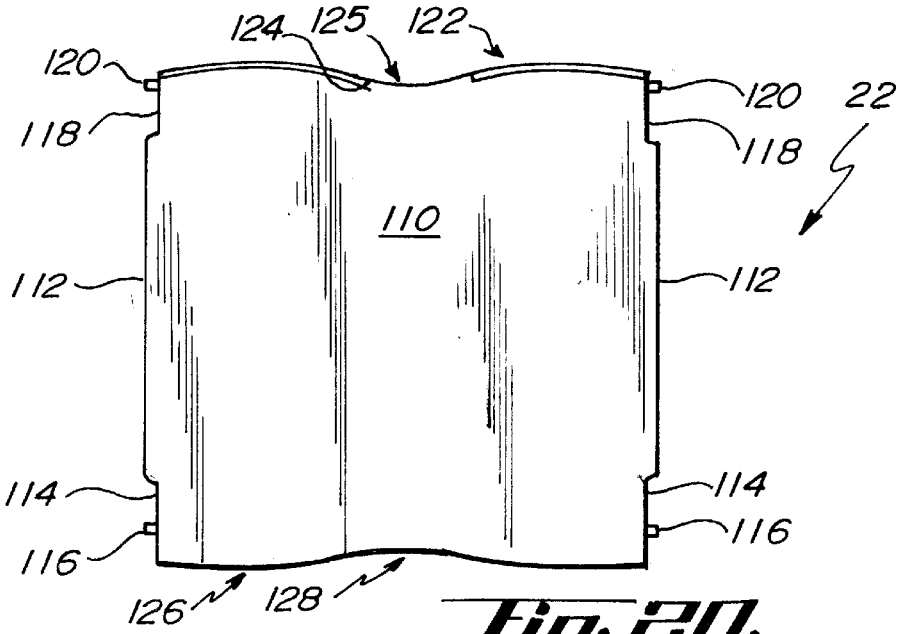
FIG. 20 is a top view of the shelf of FIG. 19.
Figure 24:
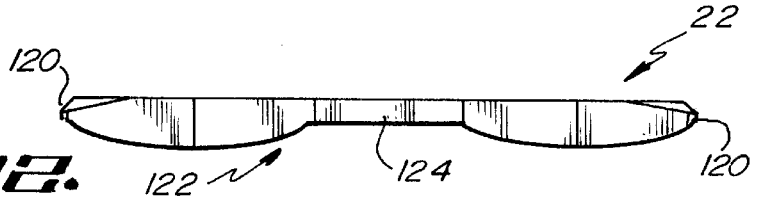
FIG. 24 is a front view of the shelf of FIG. 19 as it would appear in a display mode.

A display face 122 of shelf 22 is seen when shelf 22 is in the display orientation, and is best seen in FIGS. 19 and 24. As shown, display face 122 has a sweeping wave configuration that presents a lip edge 123 above the plane of top surface 110 to prevent papers from sliding off of shelf 22 when in display mode. A central section 124 of display face 122 is preferably of sufficient height and width to allow for placement of a shelf label (not shown). Additionally, central section 124 is provided with a slight indent 125 to allow for the papers on shelf 22 to be more easily grasped.

Figure 23:
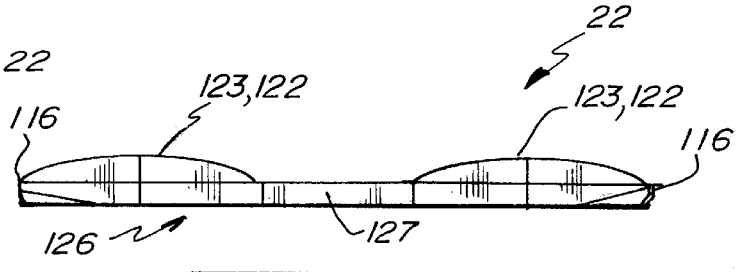
FIG. 23 is a front view of the shelf of FIG. 19 as it would appear in a storage mode.

A storage face 126 of shelf 22 is seen when shelf 22 is in the storage orientation, and is best seen in FIGS. 19 and 23. As shown, storage face 126 has a sweeping wave configuration but does not present a lip edge; no lip edge is necessary to hold papers in place as shelf 22 is substantially horizontal in the storage orientation. A central section 127 of storage face 128 is preferably of sufficient height and width to allow for placement of a shelf label (not shown). Additionally, central section 127 is provided with a slight indent 128 to allow for the papers on shelf 22 to be more easily grasped.

Figure 21:
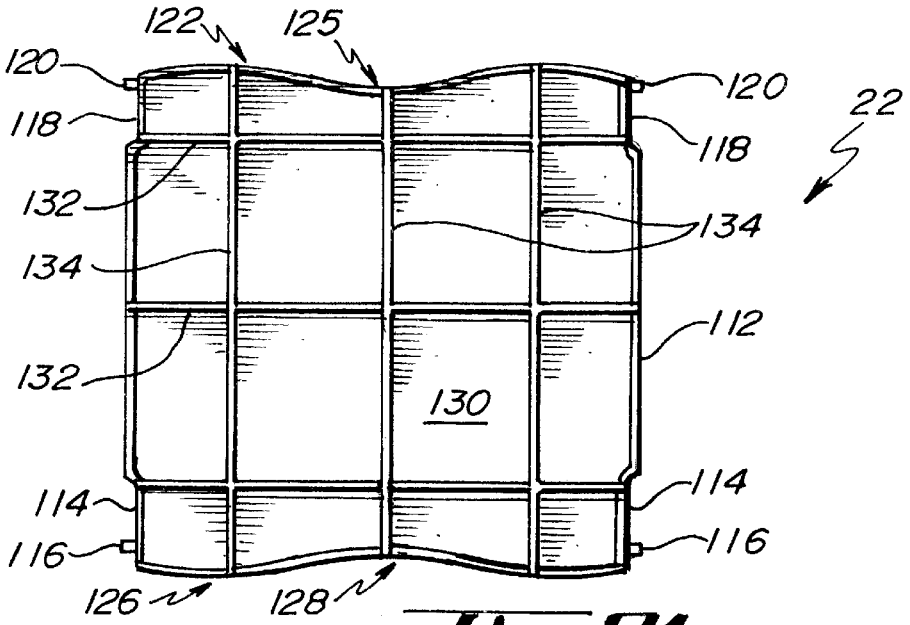
FIG. 21 is a bottom view of the shelf of FIG. 19.
Figure 22:
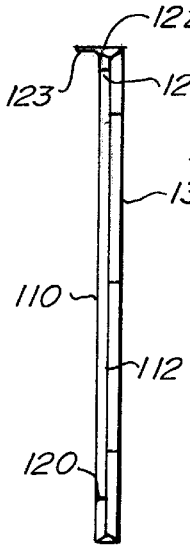
FIG. 22 is a side view of the shelf of FIG. 19.

A bottom surface 130 of shelf 22 is best seen in FIG. 21. Bottom surface 130 is substantially planar but includes a plurality of ribs 132 and a plurality of ribs 134 which are substantially transverse to ribs 132. Ribs 132 and ribs 134 aid in providing shelf 22 with structural rigidity.

Face plates 12, side panels 14, top panel 16, bottom panel 18, back panel 20 and the plurality of shelves 22 are preferably fabricated from ABS or high-impact polystyrene, however, other materials may be used without departing from the spirit or scope of the invention.

Storage and Packaging of the Modular Organizer

Figure 25:
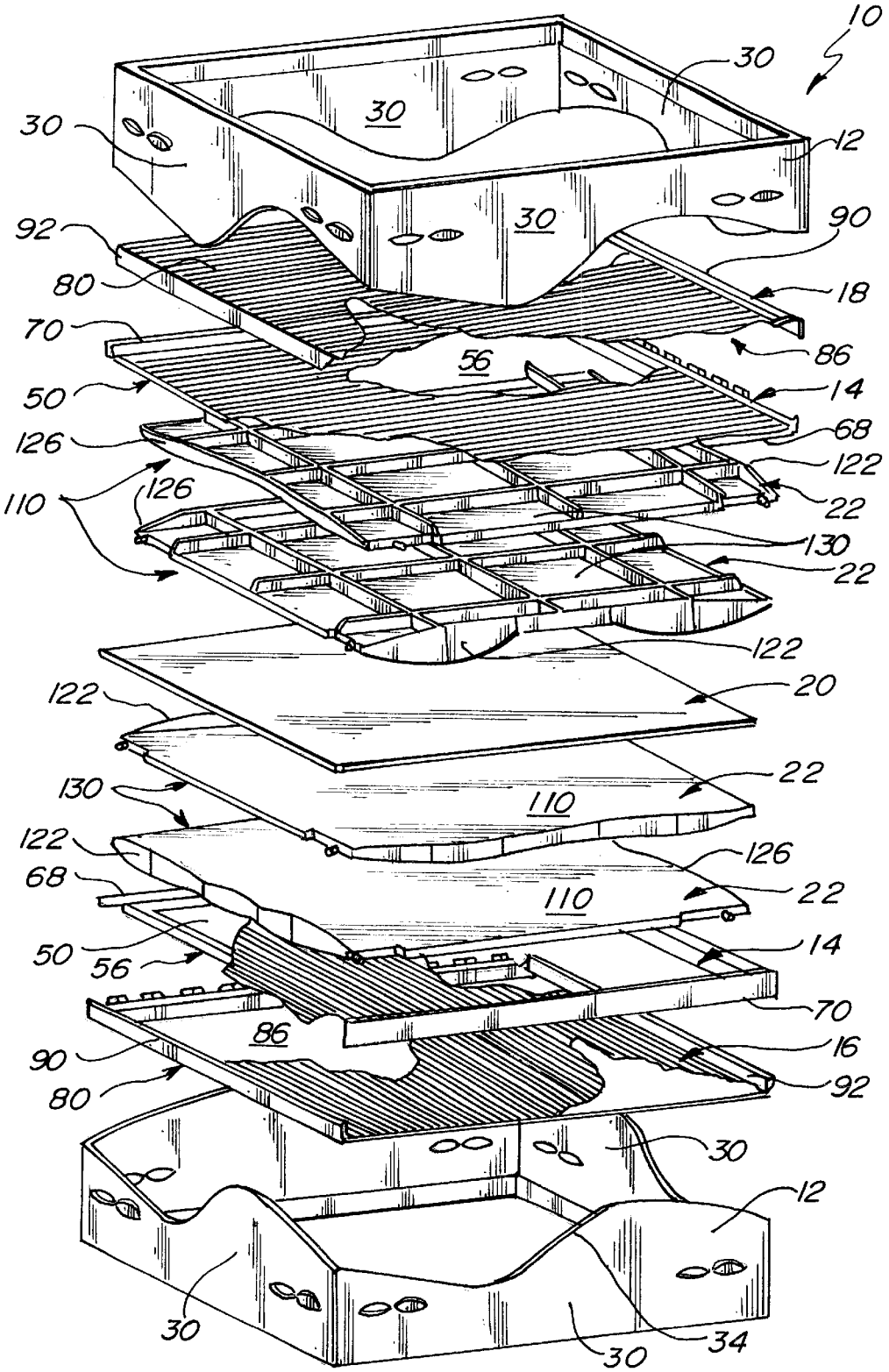
FIG. 25 is a packaging assembly view of the modular organizer of the present invention.

Modular organizer 10 is conveniently self-packaging, i.e., all shelves and panels may be stacked and contained within the structure formed by interfacing face plates 12. FIG. 25 provides a packaging assembly of the preferred stacking configuration of the components of modular organizer 10.

As shown, one of the two face plates 12 comprises the base of the packaging structure and is positioned for reception of panels and shelves by placing outline 34 upwards. Placed within the four sides 30 of faceplate 12 is top panel 16. Side panel 14 is preferably placed with outer surface 80 faced downward and inner surface 86 faced upward. Next, one of side panels 14 is preferably placed atop top panel 16. Top panel 16 is preferably placed with inner surface 56 faced downward and outer surface 50 faced upward. Additionally, side panel 14 is preferably rotated such that top edge 68 and bottom edge 70 are ninety degrees rotated from first side edge 90 and second side edge 92 of top panel 16.

Next in the preferred stacking sequence are two shelves 22. The first of shelves 22 is preferably placed atop side panel 14 with bottom surface 130 faced downward and top surface 110 faced upward. The second of shelves 22 is preferably placed atop the first of shelves 22 and is also positioned with bottom surface 130 faced downward and top surface 110 faced upward. Display face 122 and storage face 126 of the first of shelves 22 are preferably placed in substantial alignment with first side edge 90 and second side edge 92, respectively, of top panel 16. Display face 122 and storage face 126 of the second of shelves 22 are preferably rotated ninety degrees from the first of shelves 22 so as to be in substantial alignment with top edge 68 and bottom edge 70 of side panel 14. Following up the stack of FIG. 25, the next component to be placed is back panel 20.

Atop back panel 20, and reversing the order of components below back panel 20, are two more shelves 22. The first of the two shelves 22 is positioned atop back panel 20 with top surface 110 faced downward and bottom surface 130 faced upward. Display face 122 and storage face 126 of the first of two shelves 22 is preferably oriented such that they are one hundred eighty degrees opposite display face 122 and storage face 126 of shelf 22 that is located immediately below back panel 20. The second of two shelves 22 is preferably placed atop the first of two shelves 22 with top surface 110 faced downward and bottom surface 130 faced upward. Display face 122 and storage face 126 of the second of two shelves 22 are preferably oriented such that they are one-hundred eighty degrees opposite display face 122 and storage face 126 of shelf 22 that located below that shelf 22 locating immediately below back panel 22. As such, display face 122 and storage face 126 of the second of two shelves are oriented ninety degrees from display face 122 and storage face 126 of the first of two shelves 22.

Next, the second side panel 14 is placed atop the second of two shelves 22 with outer surface 50 faced downward and inner surface 56 faced upward. Top edge 68 is preferably at ninety degrees to storage face 130 of the second of two shelves 22, as shown. Bottom panel 18 (top panel 16 and bottom panel 18 are interchangeable) is then preferably stacked atop the second side panel 14 with inner surface 86 faced downward and outer surface 80 faced upward. First edge 90 and second edge 92 are ninety degrees rotated from adjacent side panel's top edge 68 and bottom edge 70 as shown.

Finally, the second of the two face plates 12 is stacked atop bottom panel 18 with outline 34 faced downward. In this position, outline 34 of the first of the two face plates interfaces with the second of the two face plates 12 and all panels and shelves of modular organizer 10 are contained within the enclosing structure of face plates 12 for storage and/or sale purposes. Note that outer surface 80 of top panel 16 and bottom panel 18 are visible through the central opening of face plates 12.

At least one additional shelf 22 may be added to the stack described above while still allowing for a complete interface between face plates 12, i.e., a closed structure. If even more shelves 22 are desired, they may be stored and/or sold separately from the stack described above.

The stacking sequence and orientation of components in the stack described above is the preferred sequence and orientation, however, it should be noted that other stacking sequences and component orientations may be used without departing from the spirit or scope of the invention.

Assembly of the Modular Organizer

The components of modular organizer 10, e.g., face plates 12, side panels 14, top panel 16, bottom panel 18 and back panel 20, may be assembled in any suitable fashion without departing from the spirit or scope of the invention. One possible and preferred assembly procedure is described below.

With modular organizer 10 packaged or stored as described above, top face plate 12 is preferably removed from the stack. Next, all components remaining within bottom face plate 12 are preferably removed and separated.

Figure 26:
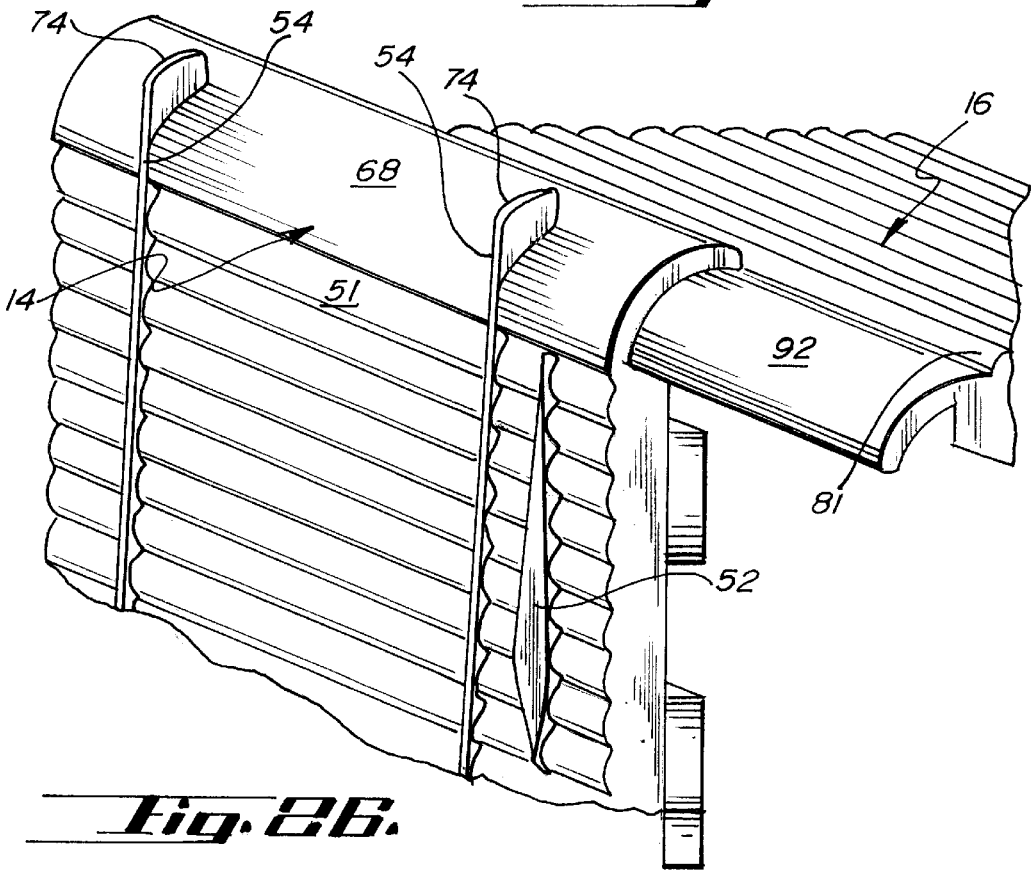
FIG. 26 depicts how the top panel of the modular organizer of the present invention and the side panel of the modular organizer are joined together.

Panels 14, 16, and 18 are then preferably assembled. As shown in FIG. 26, the first of two side panels 14 is preferably joined with top panel 16 by sliding second side edge 92 of top panel 16 between top edge 68 and lip edge 72 (not seen) of the first of two side panels 14 until top panel 16 and the first of two side panels 14 are substantially flush. With top panel 16 now presenting an open first side edge 90, bottom edge 70 of the second of two side panels 14 is slid between first side edge 90 and lip edge 94 of top panel 16 until substantially flush with top panel 16.

Figure 27:
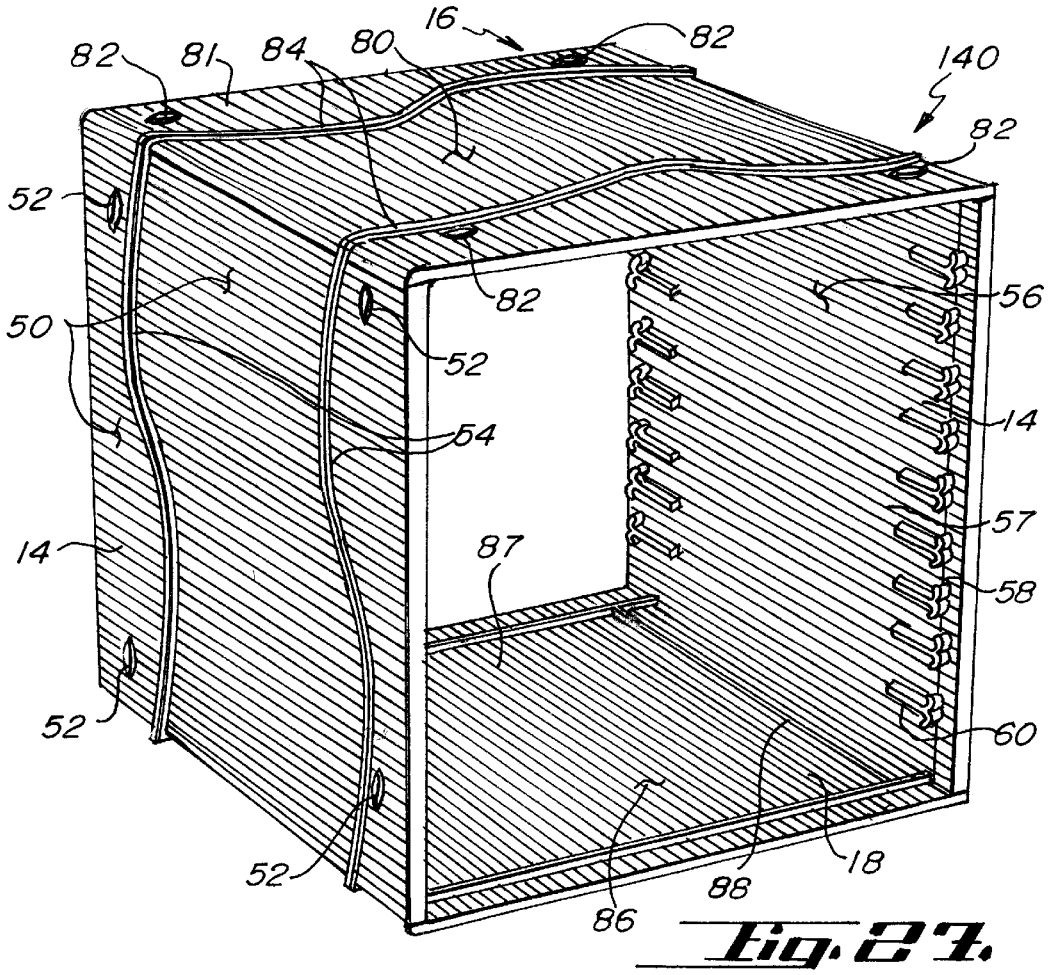
FIG. 27 depicts a partial assembly of the modular organizer of the present invention.

Next, bottom panel 18 is joined with open bottom edge 70 of the first of two side panels 14 and open top edge 68 of the second of two side panels 14. As such, bottom edge 70 of the first of two side panels 14 is slid between first side edge 90 and lip edge 94 of bottom panel 18 until flush with bottom panel 18 and second side edge 92 of bottom panel 18 is slid between top edge 68 and lip edge 72 of the second of side panels 14. Thus, an open-ended cube 140, see FIG. 27, has now been established having the preferred dimensions of approximately 11.8 by 11.8 by 11.8 inches.

Figure 28:
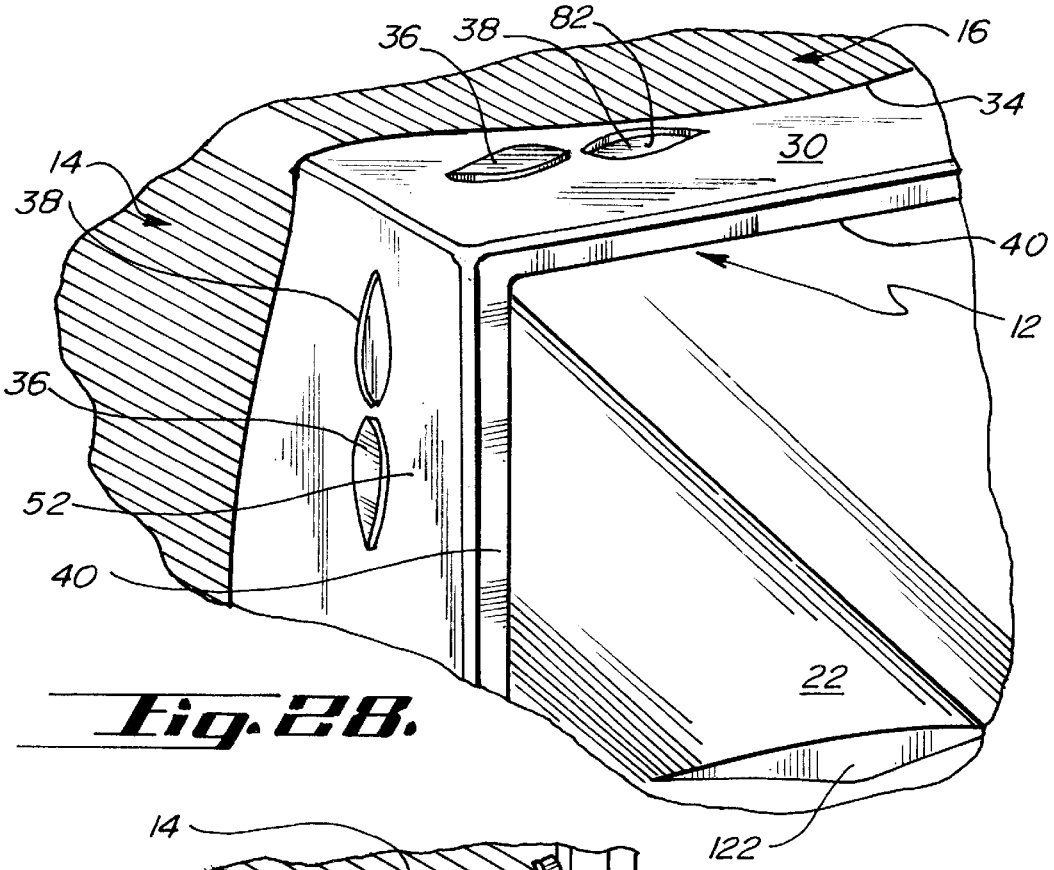
FIG. 28 depicts how the face plate of the modular organizer of the present invention fits over the joined top panel and side panel.

Next, the first of two face plates 12 is placed on a surface with outline 34 faced upward. Back panel 20 is then inserted between inner wall portions 43 of the four sides 30 of the first of two face plates 12. Inner lip portion 42 of face plate 12 serves to prevent back panel 20 from completely sliding through face plate 12. Next, one end of open-ended cube 140 is preferably inserted into the first of two face plates 12. That is, each of panels 14, 16, and 18 are inserted into slot openings 44. In doing so, upper portion 32 of face plate 12 slides over outer surface 50 of each side panel 14 and over outer surface 80 of top panel 16 and bottom panel 18. Face plate 12 continues to slide until bosses 52 of side panels 14 and bosses 82 of top panel 16 and bottom panel 18 engage holes 38 on sides 30 of face plate 12. Note that bosses 52 and 82 do not extend through the complete depth of holes 38 but rather, extend only partially, e.g., approximately half-way, into holes 38. Referring to FIG. 28, bosses 52 and 82 are shown engaged with holes 38.

With open-ended cube 140 substantially secured to one of two face plates 12, the second of two face plates 12 is preferably slid over the remaining open end of cube 140. Again face plate 12 is slid over outer surface 50 of each side panel 14 and over outer surface 80 of top panel 16 and bottom panel 18 until bosses 52 and bosses 82 engages holes 38 on the second of two face plates 12. Again, bosses 52 and bosses 82 do not extend through the complete depth of holes 38 but rather, extend only partially, e.g., approximately half-way, into holes 38. With both face plates 12 secure, modular organizer 10 presents a cube with the preferred approximate dimensions of 12 by 12 by 12 inches.

Modular organizer 10 may now be placed upright, i.e., in an orientation where back panel 20 is to the rear and shelf supports 60 of side panels 14 are to the side. In this position, modular organizer is ready to accept one or more shelves 22, see FIG. 29. Shelves 22 may be positioned within modular organizer 10 in either a storage mode or a display mode. In storage mode, shelf 22 is in a substantially horizontal orientation. As such, shelf 22 is inserted between an upper hook portion 64 and a lower hook portion 66 of adjacent shelf supports 60 with display face 122 towards back panel 20. Once inserted, shelf 22 is then lowered to allow storage posts 116 and display posts 120 to rest on those leaders 62 connected to the described upper hook portion 64 at the front and corresponding rear location in modular organizer 10.

Figure 29:
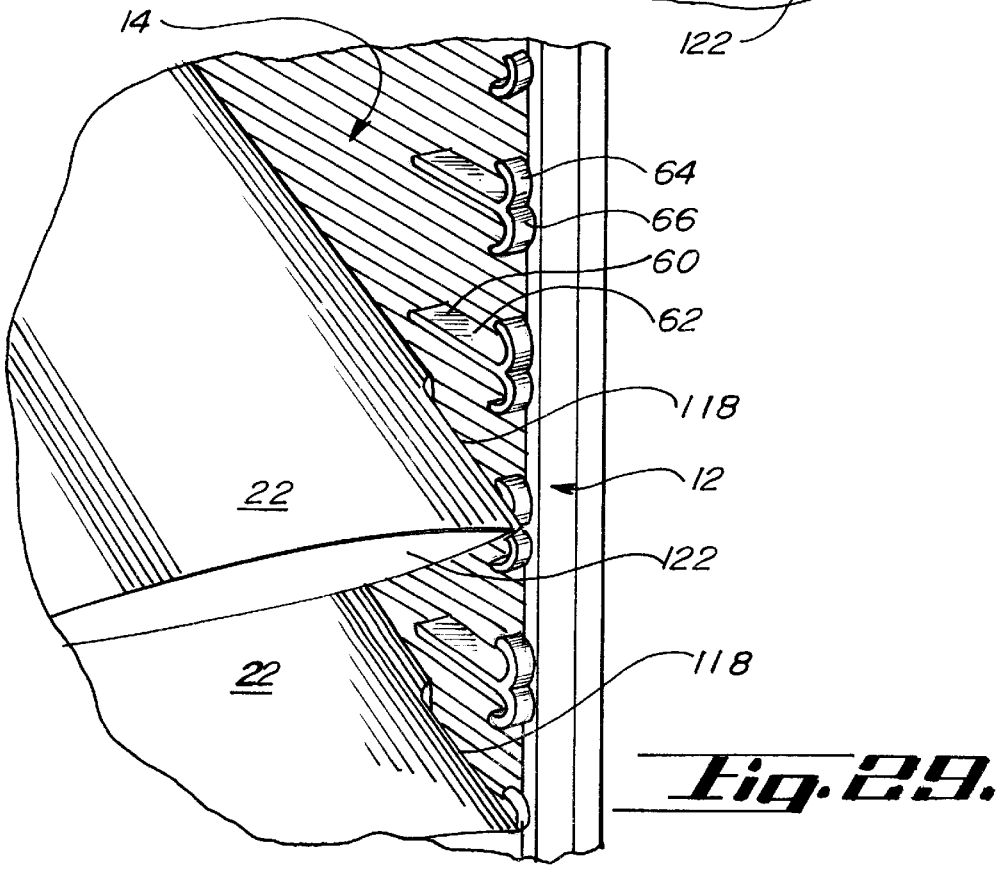
FIG. 29 depicts the placement of a shelf in display mode.

In display mode, see FIG. 29, shelf 22 is positioned at a downward sloping angle. As such, shelf 22 is preferably inserted between one of upper hook portions 64 and one of lower hook portions 66 of adjacent shelf supports with storage face 126 towards back panel 20. Once inserted, shelf 22 is pulled forward so that display posts 120 generally engage upper hook portion 64 to the front of modular organizer 10. Then shelf 22 is tilted upward and pushed backward slightly so that storage posts 116 may engage one of lower hook portions 66 on shelf support 60, which is to the rear of modular organizer 10, that is located above shelf support 60 on which display posts 120 rest.

Numerous shelves 22 may be incorporated into modular organizer 10 in either storage mode, display mode, or a combination of both, as desired. Atop shelves 22 may be placed loose papers, binders, books, office products, drawer inserts and the like.

Assembly of Modular Units

Figure 30A:
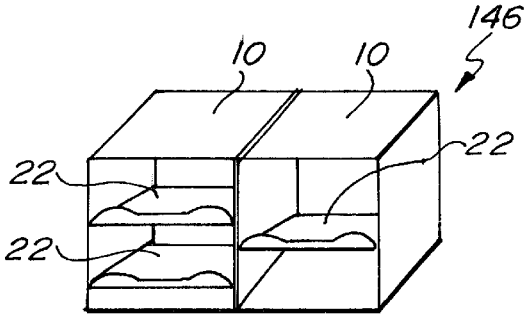
FIGS. 30A–30E depict various modular unit configurations of the present invention.
Figure 30B:
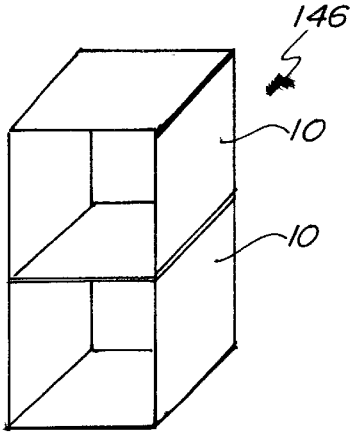

Modular organizer 10 may be used alone, e.g., placed on a desk top or table, or in combination with additional modular organizers 10 to form a modular unit 146. Referring to FIG. 30, a plurality of modular unit 146 configurations are presented (details for each modular organizer 10 have been omitted for clarity of view). FIG. 30A depicts a side-by-side modular unit 146 which incorporates two modular organizers 10. This type of modular unit 146 configuration is appropriate for almost any setting and is especially appropriate for a desktop or table. FIG. 30B depicts a tower-type arrangement of modular unit 146 wherein two modular organizers 10 are stacked atop each other. This type of modular unit 146 configuration is appropriate for both floor and desk top settings.

Figure 30C:
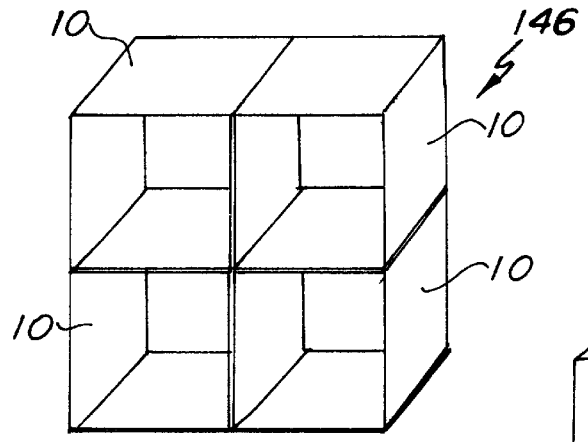
Figure 30D:
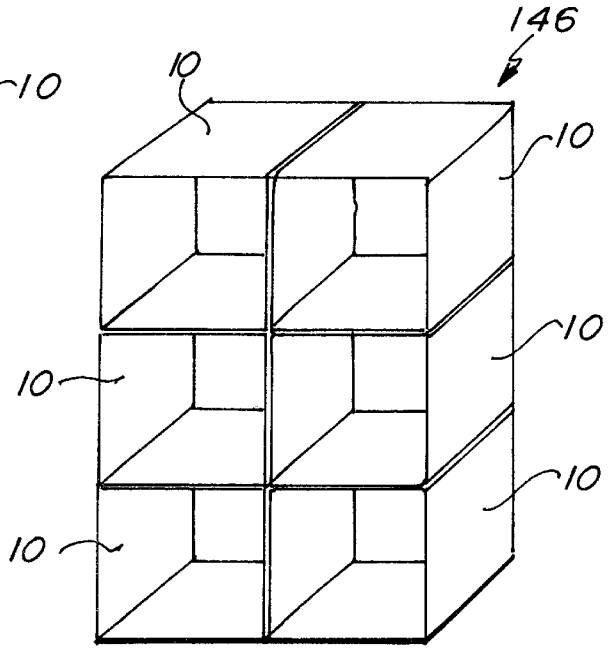
Figure 30E:
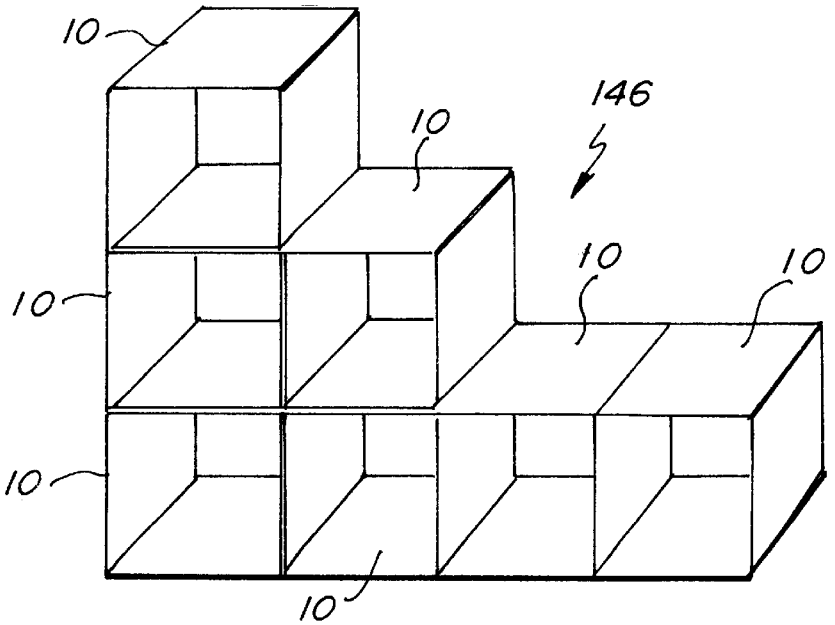

The modular unit 146 configuration of FIG. 30C is a cube configuration using two modular organizers 10 that are adjacent and atop two additional modular organizers 10. The modular unit 146 configuration of FIG. 30D is a two by three tower configuration of modular organizers 10 and is appropriate for both floor and desktop settings. FIG. 30E exemplifies how multiple modular organizers 10 may be combined to create virtually any desired modular unit 146 configuration. Here, four modular organizers 10 form the base of unit 146 with two additional modular organizers 10 atop the base, and with one additional modular organizer 10 atop the two. Of course, numerous other modular unit 146 configurations utilizing modular organizers 10 are possible without departing from the spirit or the scope of the invention.

Figure 2:
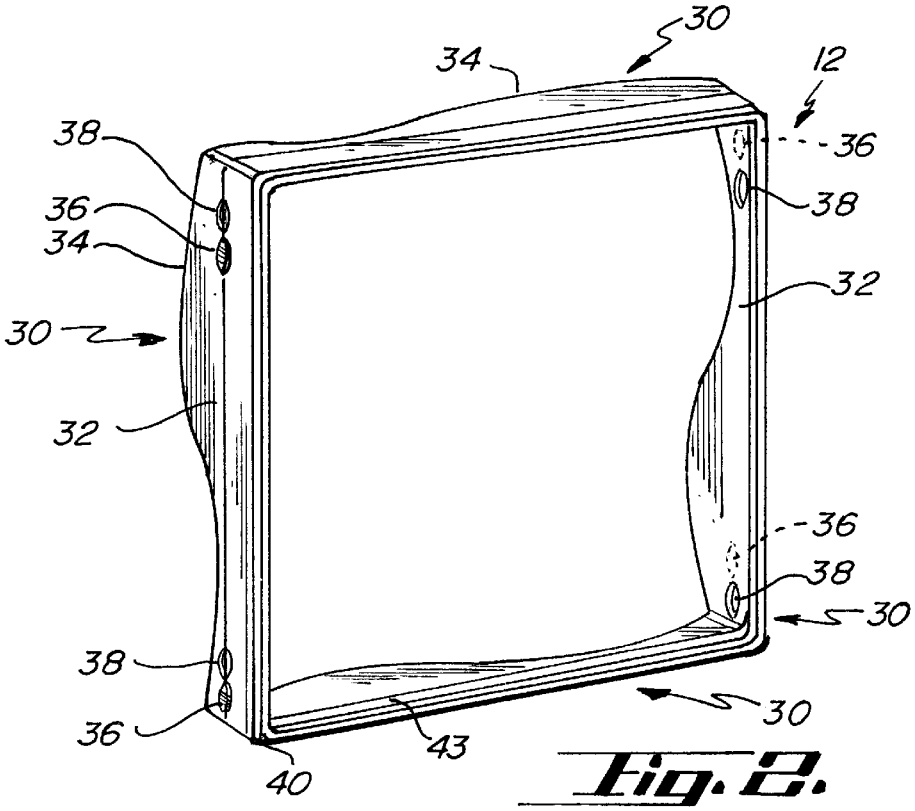
FIG. 2 is a perspective view of a face plate of the modular organizer of the present invention.
Figure 3:
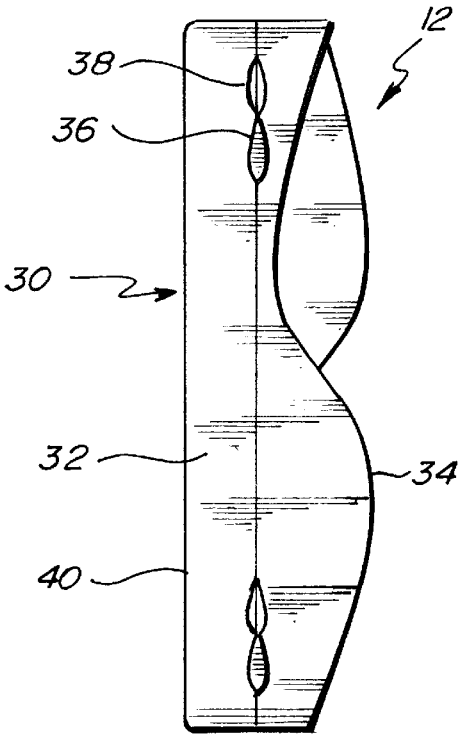
FIG. 3 is a side view of the face plate of FIG. 2.
Figure 4:
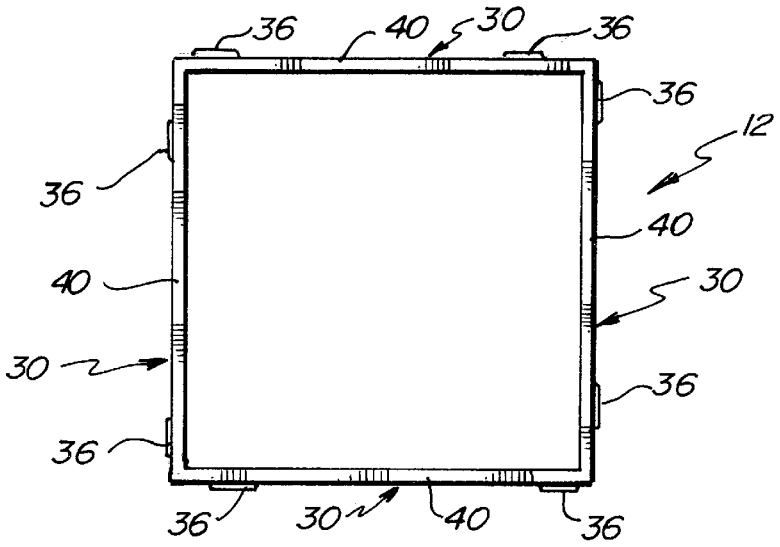
FIG. 4 is a front view of the face plate of FIG. 2.
Figure 5:
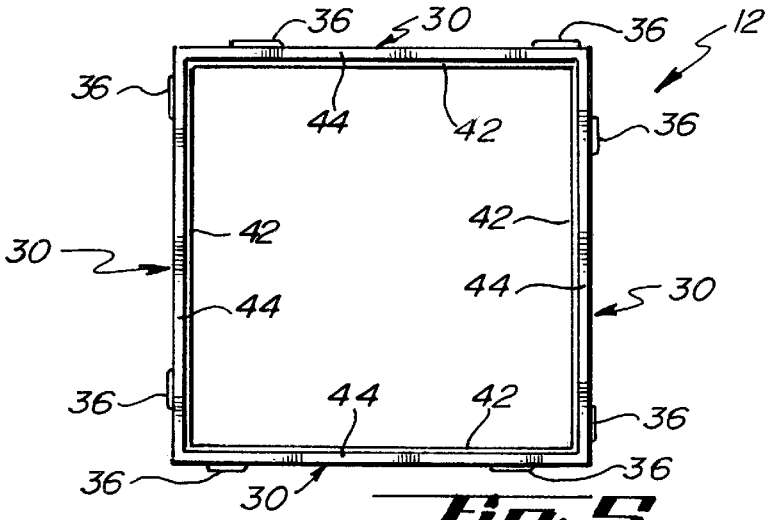
FIG. 5 is a back view of the face plate of FIG. 2.
Figure 6:
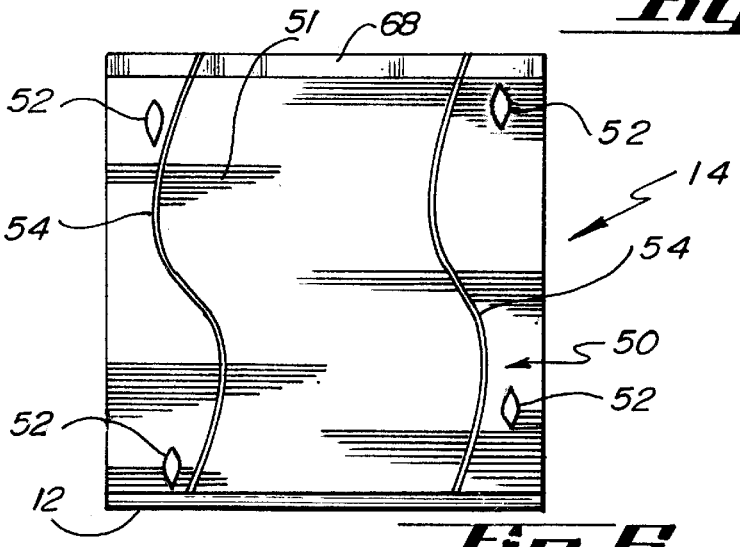
FIG. 6 is an outside view of a side panel of the modular organizer of the present invention.
Figure 7:
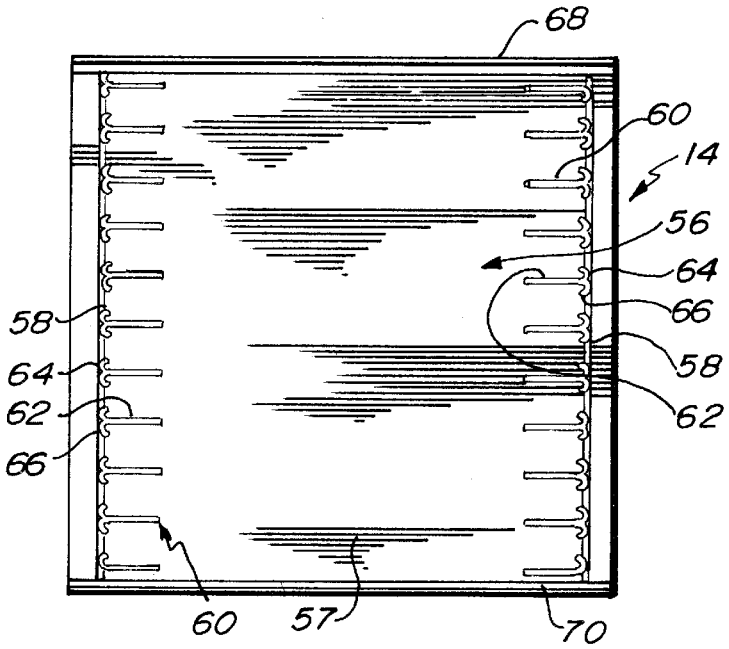
FIG. 7. is an inside view of the side panel of FIG. 6.

Modular organizers 10 are especially suited for stacking and side-by-side placement. One modular organizer 10 is held adjacent a second modular organizer 10 by virtue of posts 36 and holes 38 of face plates 12. If a first modular organizer 10 is placed into position, wherein looking to the left of front face plate 12, hole 38 appears at the top of left side 30, as shown in FIG. 2, then the right side 30 of the same face plate 12 has post 36 at its top. As such, to join two modular organizers 10 in a side-by-side configuration, a second modular organizer 10 is placed beside first modular organizer 10, in the same orientation as first modular organizer 10. In this presentation, when modular organizers 10 are pressed together, post 36 on the top, right side 30 of the first modular organizer 10 engages hole 38 on the top, left side 30 of the second modular organizer 10, and likewise with the additional posts 36 and holes 38 along the right side 30 of the front and rear face plate 12 of the first modular organizer and the left side 30 of the front and rear face plate of the second modular organizer. Similarly, when adjoining two modular organizers 10 one atop the other, each modular organizer 10 should be oriented identically to ensure a match up of post 36 to hole 38 for each face plate 12.

It should be noted that post 36 does not extend through the complete depth of hole 38 but rather, extends only partially, e.g., approximately half-way, into hole 38. In this manner, each of holes 38 has a dual purpose of engaging bosses 52 and 82 on the panels and engaging posts 36 on face plates 12.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed:

1. A configurable modular organizing unit comprising:

a first modular organizer, wherein said first modular organizer includes a post and hole pair, wherein said post and hole pair are formed unitary with said first modular organizer; and a second modular organizer, wherein said second modular organizer includes a post and hole pair that is formed unitary with said second modular organizer and that is opposite in orientation to said post and hole pair of said first modular organizer, and wherein upon placing said second modular organizer adjacent said first modular organizer, said post of said first modular organizer engages said hole of said second modular organizer, and said post of said second modular organizer engages said hole of said first modular organizer.

2. The unit of claim 1, wherein said first modular organizer and said second modular organizer each have four sides, and wherein each of said four sides includes post and hole pair.

3. The unit of claim 2, wherein each of said four sides includes at least two post and hole pairs.

4. The unit of claim 3, wherein the at least two post and hole pairs are identically oriented.

5. The unit of claim 4, said post and said hole of the said at least two post and hole pairs are adjacently positioned and substantially identical in shape.

6. The unit of claim 1, wherein said first modular organizer and said second modular organizer each include a panel with a post extending therefrom, and wherein said post of said panel engages said hole of its respective modular organizer.

7. The unit of claim 1, said post and said hole of said post and hole pair are adjacently positioned and substantially identical in shape.

8. A configurable modular organizing unit comprising:

a plurality of organizers, each of said organizers means having two sets of parallel sides, wherein said two sets of parallel sides are configured in a square or rectangular orientation, and wherein within each set of parallel sides each side includes a post and hole combination that has been formed unitary with the side, and wherein within each set of parallel sides the unitary post and hole combination of one parallel side is opposedly (oppositely) positioned and reverse oriented from the unitary post and hole combination of the other parallel side, wherein upon positioning a first of said plurality of organizers adjacent a second of said plurality of organizers the post and hole combination of said first of said plurality of organizers engages the reversely positioned post and hole combination of the second of said plurality of organizers to form a modular organizing unit.

9. The unit of claim 8, wherein a placement of said second of said plurality of organizers adjacent said first of said plurality of organizers is selected from a group consisting of: side-by-side adjacent placement, top-to-bottom adjacent placement, and bottom-to-top adjacent placement.

10. The unit of claim 8, wherein within each set of parallel sides each side includes at least two post and hole combinations, each post and hole combination of one side being oppositely positioned and reversely oriented from the post and hole combination of the parallel side.

11. The unit of claim 10, wherein the at least two post and hole combinations of one side are identically oriented on the side.

12. The unit of claim 11, wherein the post and hole combination comprises a post that is adjacently positioned and substantially identical in shape to a hole.

13. The unit of claim 8, wherein the post and hole combination comprises a post that is adjacently positioned and substantially identical in shape to a hole.

* * * * *

UNITED STATES PATENT AND TRADEMARK OFFICE

CERTIFICATE OF CORRECTION

PATENT NO. : 6,422,398 B2 
DATED : July 23, 2002
INVENTOR(S) : Pamela R. LaFontaine and Stanley R. Thorud It is certified that error appears in the above-identified patent and that said Letters Patent is hereby corrected as shown below:

Title page,
Item [57], ABSTRACT,
Line 4, please change “face plates” to -- faceplates --.

Column 1,
Line 18, please change “suite” to -- suit --.

Column 3,
Line 46, please change “comers” to -- corners --.

Column 4,
Line 21, please change “comer” to -- corner --.

Column 6,
Line 24, please add -- are -- between “that” and “located”.
Line 25, please change “locating” to -- located --.

Column 10,
Line 5, please delete the word “means”.

Signed and Sealed this

Twenty-sixth Day of November, 2002

*Attest:*

*Attesting Officer*

JAMES E. ROGAN
*Director of the United States Patent and Trademark Office*